United States Patent [19]

Dezubay et al.

[11] Patent Number: 4,793,269

[45] Date of Patent: Dec. 27, 1988

[54] KILN FOR WASTE DISPOSAL

[75] Inventors: Egon A. Dezubay, Mt. Lebanon; Graham A. Whitlow, Murrysville, both of Pa.

[73] Assignee: Westinghouse Electric Corp., Pittsburgh, Pa.

[21] Appl. No.: 161,538

[22] Filed: Feb. 29, 1988

[51] Int. Cl.[4] ..... A47J 36/00; A47J 36/24

[52] U.S. Cl. ..... 110/246; 110/226; 432/77; 432/116

[58] Field of Search ..... 110/246, 226; 432/113, 432/116, 77

[56] References Cited

U.S. PATENT DOCUMENTS

| | | | |
|---|---|---|---|
| 3,822,651 | 7/1974 | Harris et al. | 110/234 |
| 4,226,584 | 10/1980 | Ishikawa | 432/77 |
| 4,584,180 | 4/1986 | Ostrov | 432/77 X |
| 4,724,778 | 2/1988 | Healy | 110/246 |
| 4,726,765 | 2/1988 | O'Connor | 110/246 X |
| 4,734,166 | 3/1988 | Angelo | 110/246 X |
| 4,735,156 | 4/1988 | Johnson et al. | 110/246 |
| 4,735,157 | 4/1988 | Jurusz | 110/246 |

*Primary Examiner*—Edward G. Favors

[57] ABSTRACT

A water cooled kiln comprises a cylindrical combustor structure made up of a plurality of generally parallel water pipes spaced circumferentially about the periphery of the structure, and a plurality of webs circumferentially interconnecting the pipes so as to present the cylindrical combustor structure. The webs are provided with openings so that combustion air may flow therethrough and into the combustion chamber defined by the cylindrical combustor structure. The webs are protected from corrosion and erosion by the provision of a protective sheet constructed of a corrosion resistant material which is placed in covering relationship to the web inside the chamber. The protective sheet is spaced slightly from the web by dimples or corrugated strips and is attached to the web by spot welding for example. Air proceeding toward the combustion chamber enters through the opening in the web and is diverted by the protective sheet so that the air flows through the plenum between the web and the sheet and cools both the web and the sheet to diminish the corrosive and erosive effects inherent in the combustion chamber. The diverted air flows through the plenum and enters the chamber about the edges of the protective sheet.

9 Claims, 3 Drawing Sheets

10
12
14
16
18
20
22
24
26
28
2

KILN FOR WASTE DISPOSAL

BACKGROUND OF THE INVENTION

1. Field of the Invention

The present invention relates to kilns for waste disposal and in particular to means for use in municipal waste incinerators for inhibiting corrosion and erosion within the structure.

2. The Prior Art Environment

Water cooled kilns for waste disposal are well known, and an important constructional configuration which has found a great deal of use, particularly in municipal solid waste applications, is the kiln of Harris and O'Connor disclosed in U.S. Pat. No. 3,822,651. This particular kiln has become known as the Westinghouse-O'Connor Combustor, or WOCC for short. A WOCC kiln, which may also be referred to as a rotary combustor, is formed from a number of water pipes which are interconnected by perforated strips or web sections, all welded together to present a cylinder defining a combustion chamber. The perforations in the strips or web sections permit air to enter the combustion chamber radially through the cylinder wall, and provide air jets for the burning waste in the interior of the cylinder.

The '651 patent, cited above, illustrates the overall configuration of the combustion system, and the entirety of the disclosure of said '651 patent is hereby specifically incorporated herein by reference. During operation of the WOCC illustrated in the '651 patent, when the cylinder rotates about its slightly inclined axis, the unburned, partially or completely burned solid waste tumbles and repeatedly rests, at least for finite periods of time, on the bottom of the cylinder. The plates or webs separating the water pipes are alternatively exposed to solid waste in various stages of oxidation ranging from a wet unburned condition to a glowing mass. The web sections tend to corrode, with the greatest wastage in the vicinity of the air emission holes, as a result of the combined effects of corrosion caused by chlorine accelerated oxidation and erosion at high temperature. In fact, wastage may be so high that web replacement becomes necessary after only a few years of operation.

SUMMARY OF THE INVENTION

The problems described above, which are inherent in kilns of the sort described, are addressed by the present invention which provides an improved rotary kiln device for burning waste solids. The improved kiln device includes an elongated, generally cylindrical combustor structure defining an internal combustion chamber and means mounting the structure for rotation about its longitudinal axis. In accordance with the invention, the combustor structure comprises a plurality of generally parallel water pipes spaced circumferentially about the periphery of the structure. Means for interconnecting the pipes is provided, such means comprising a plurality of individual webs, each web being disposed to extend longitudinally of the structure between a respective adjacent pair of pipes for circumferentially interconnecting the latter. Each web comprises structure defining at least one opening which provides access to the chamber for combustion air. Protective means including at least one protective sheet for each of the webs is provided by the invention. Spacer means are provided for mounting each sheet on its respective web, internally of the chamber and in slightly spaced, generally parallel relationship relative to the web. The web and the sheet thus define a plenum therebetween. Also provided by the present invention are means for diverting combustion air flowing through each opening and toward the chamber, and causing such air to flow through the plenum across the surfaces of the sheet and the web for cooling the latter prior to introduction of the combustion air into the chamber.

Thus, the present invention provides a cover comprising a thin protective sheet, preferably of corrosion resistant material, for the thick web sections. The cover is cooled by incoming air. In effect, the web sections are protected by an air cooled metal cover, the thickness of which may be as thin as possible, consistent with the mechanical loads imposed by the tumbling solid waste. The protective sheet may be spaced away from the webs by dimples or corrugated strips and may be attached to the underlying web by welding, for example, using spot or laser welds. Such spacing presents a plenum allowing air to flow between the web and the protective sheet providing cooling for the web and the protective sheet and preventing corrosive and erosive materials from contacting the web. The burden of corrosion and erosion protection thus is on the protective sheet, which may be optimized for individual applications. For example, the protective sheets may be formed from "pre-dimpled" or "pre-corrugated" sheets fabricated using custom design rolls in a mill.

DETAILED DESCRIPTION OF THE PREFERRED EMBODIMENTS

Figure 1:
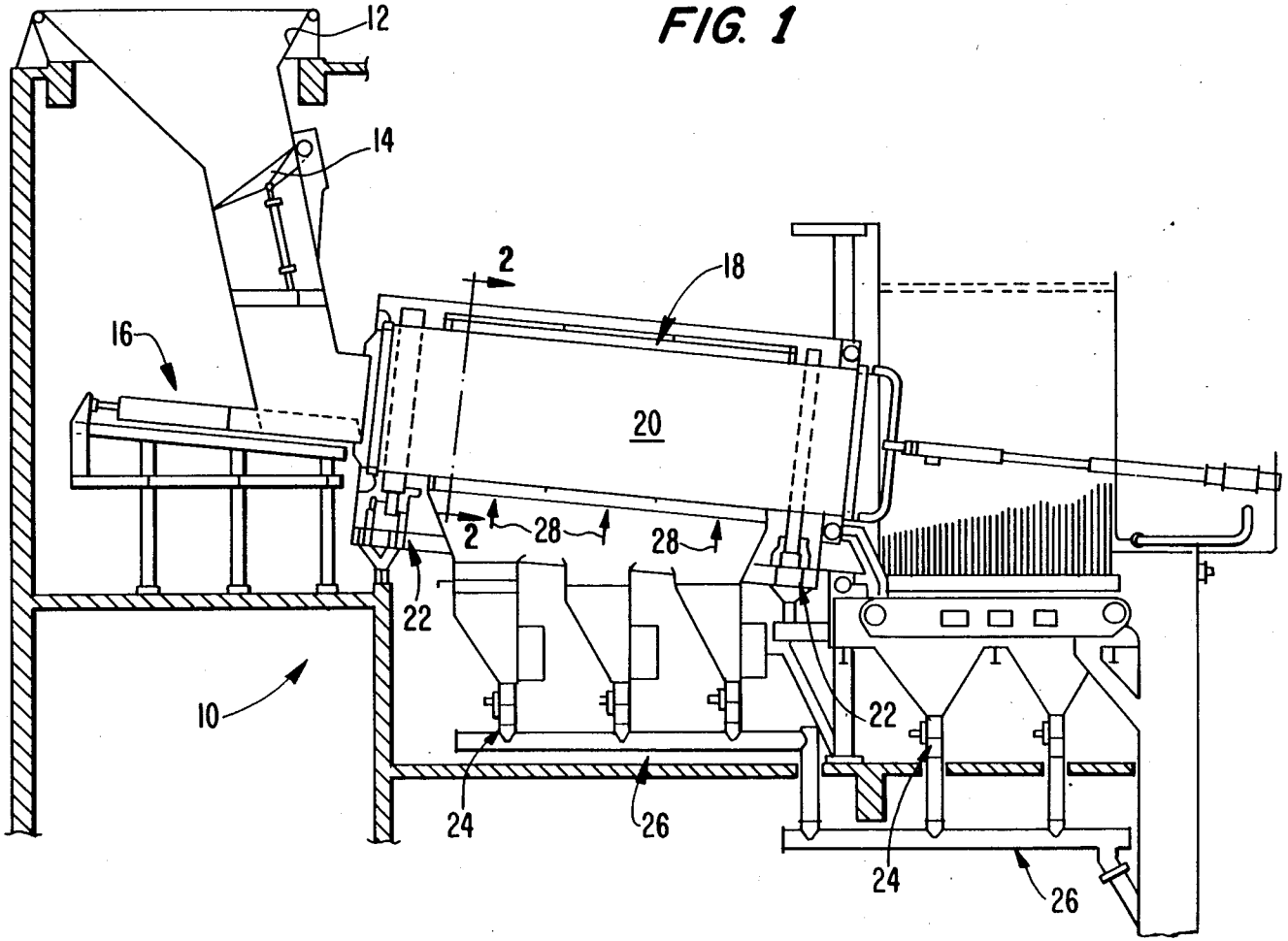
FIG. 1 is a schematic, vertical cross-sectional view illustrating a kiln and associated structure and which includes the concepts and principles of the present invention.

FIG. 1 illustrates a rotary kiln device 10 which provides an environment for the present invention. The kiln 10 is essentially of the same sort as the water cooled kiln disclosed in U.S. Pat. No. 3,822,651 and which may be referred to as the Westinghouse-O'Connor Combustor (WOCC). The kiln 10 includes a hopper 12 where waste material such as municipal solid waste (MSW) is introduced in a known manner by way of a hopper gate 14. A ram feeder 16 shoves the solid waste from hopper 16 into an elongated, generally cylindrical combustor structure 18 which defines an internal combustion chamber 20. The combustor structure 18 is mounted by means 22 in the nature of conventional supporting rollers, for rotation about its longitudinal axis.

Conventional means, in the nature of ash valves 24 and screw conveyors 26 are provided to facilitate the combustion process, and combustion air is introduced into the combustion chamber 20 in a radial direction as indicated by the arrows 28.

The kiln includes all of the other accessories and components necessary for burning materials such as municipal solid waste, and further description is not necessary here. Suffice it to say, that the conventional details of a kiln of the sort which may be protected from corrosion by the present invention are fully disclosed in said '651 prior patent.

Figure 2:
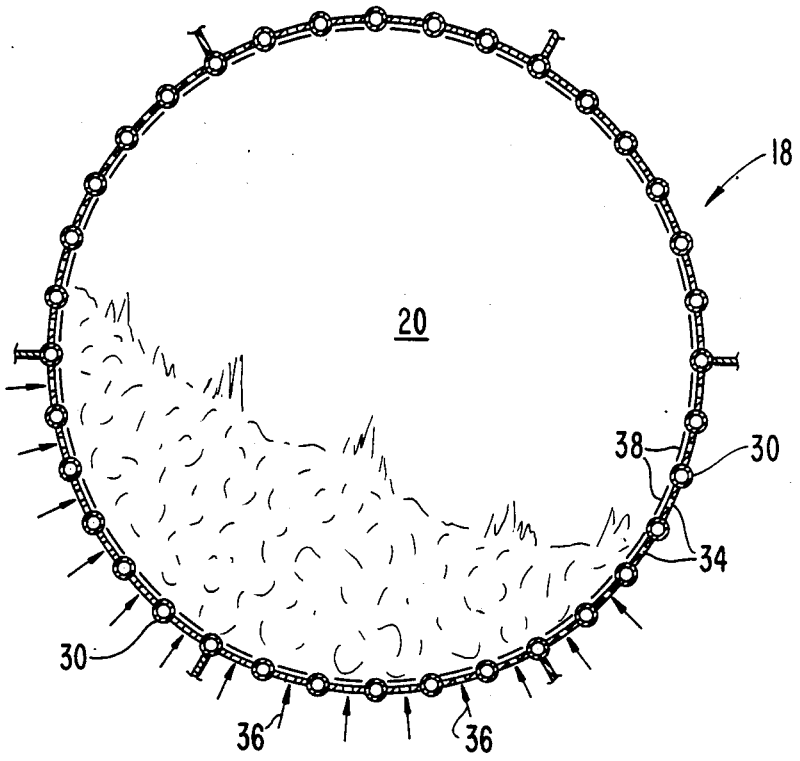
FIG. 2 is an enlarged cross-sectional view taken approximately along the line 2—2 of FIG. 1.
Figure 3:
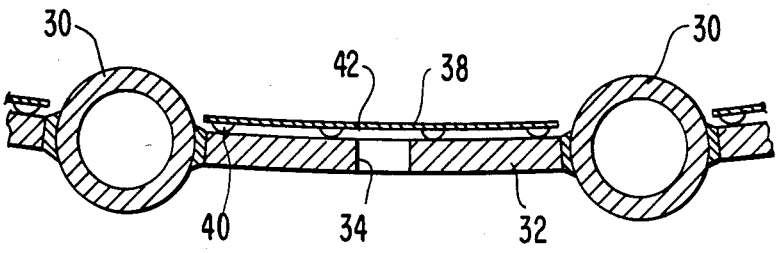
FIG. 3 is an enlarged, fragmentary cross-sectional view illustrating a portion of the structure shown of FIG. 2.

The elongated, generally cylindrical combustor structure 18 comprises a plurality of generally parallel water pipes 30 which, as can be seen particularly in FIG. 2, are spaced circumferentially about the periphery of structure 18. Structure 18 also comprises web means in the nature of a plurality of individual webs 32 for interconnecting pipes 30 to present structure 18. The individual webs 32, as can be seen in FIGS. 2 and 3, are each disposed to extend longitudinally of the structure between a respective adjacent pair of pipes 30 for circumferentially interconnecting the latter. With particular reference to FIG. 3, it can be seen that each web comprise a structure defining an opening 34 which provides radial access to chamber 20 for combustion air.

As is illustrated in FIG. 2, combustion air is introduced into chamber 20 radially through openings 34 in the direction indicated by arrows 36.

Figure 4:
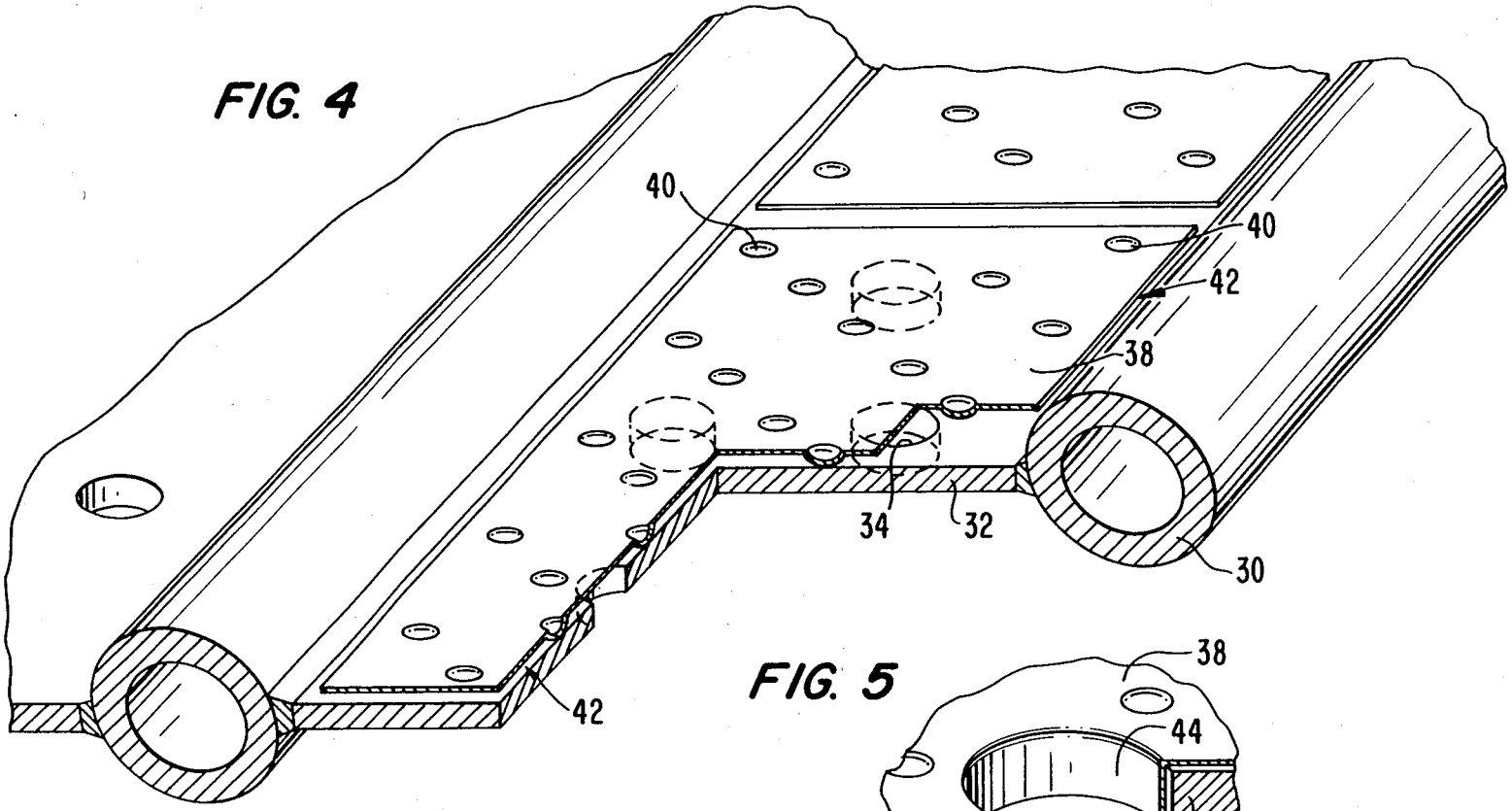
FIG. 4 is a perspective view illustrating the protective sheet and the relationship of the sheet to the web interconnecting the water pipes in accordance with the concepts and principles of the invention.

In accordance with the present invention, protective means in the nature of one or more protective sheets 38 is provided for each web 32. The protective sheets and the manner in which the same are mounted on webs 32 are illustrated in FIG. 4, where it can be seen that spacer means, in the nature of a plurality of spacing dimples 40, are provided for each sheet 38. Dimples 40 may be formed in sheet 38 by conventional forming processes and function to maintain each sheet 38 in slightly spaced, generally parallel relationship relative to the corresponding web. The protective sheets 38 are disposed internally of the chamber 20, and as can be seen in FIGS. 3 and 4, sheets 38 and the corresponding webs 32 define a plenum 42 therebetween. Sheets 38 may be fixed to the corresponding webs 32 by spot welding at each dimple 40, and it is to be understood that one of the purposes of the invention is to provide protection for webs 32 and facilitate ultimate repair. Thus, the protective sheets 38 should be affixed to the corresponding webs 32 in a manner which facilitates removal of the protective sheets without substantial damage to the webs so that replacement sheets may be quickly and easily installed.

The sheets 38 extend over openings 34 and thus provide means for diverting combustion air flowing through openings 34 and causing the combustion air to flow through plenum 42 and across the surfaces of sheets 36 and webs 32 for cooling the sheets and the webs before the combustion air is introduced into chamber 20. The cooling of the web 32 and the protective sheets 38, and particularly the latter, is an important aspect of the present invention since cooling of the sheets 38 assists in the prevention of corrosion and/or erosion.

The protective sheets 38 preferably should be constructed of a corrosion resistant material. Inconel 625 has been found to provide good results, and other known high alloy materials may provide comparable protection.

In the construction illustrated in FIG. 4, all of the cooling air is diverted by sheets 38 which thus provide means for diverting the cooling air. All of the cooling air flows through the plenum 42 and enters chamber 20 by flowing around the edges of the corresponding sheet 38.

Figure 5:
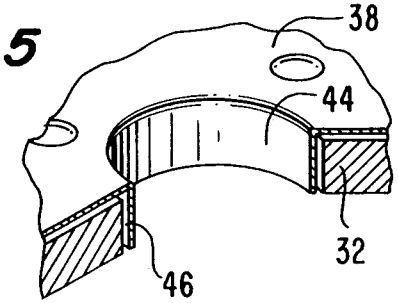
FIG. 5 is a fragmentary view illustrating a second embodiment of the invention.

It has been found that the amount of air required to produce reasonable cooling of the protective sheet 38 and the corresponding web 32 may be as low as 6 to 10% of the total flow. Accordingly, it is not necessary for all of the air to be diverted through the plenum 42. Instead, a design such as is illustrated in FIG. 5 might well be used. In FIG. 5 it can be seen that sheet 38 has been formed in such a way that a cylindrical structure 44 extends from sheet 38 and protrudes toward and into the corresponding opening 34 in web 32. Structure 44 has an outer diameter which is smaller than the internal diameter of opening 34 and thus presents an air scoop 46 in opening 34 for diverting at least a portion of the combustion air flowing through opening 34 and causing the diverted air to flow around the outside of structure 44 and through plenum 42.

We claim:

1. A rotary kiln device for burning waste solids including an elongated, generally cylindrical combustor structure defining an internal combustion chamber and means mounting said structure for rotation about its longitudinal axis, said structure comprising:

a plurality of generally parallel water pipes spaced circumferentially about the periphery of said structure;

means interconnecting said pipes and comprising a plurality of individual webs, each disposed to extend longitudinally of the structure between a respective adjacent pair of pipes for circumferentially interconnecting the latter, each web comprising structure defining at least one opening providing access to the chamber for combustion air;

protective means including at least one protective sheet for each web;

spacer means mounting each sheet on its respective web, internally of the chamber, and in slightly spaced and generally parallel relationship relative to the web, said web and said sheet defining a plenum therebetween; and means for diverting combustion air flowing through said opening and toward the chamber and causing such air to flow through the plenum across a surface of the sheet for cooling the latter prior to introduction of the combustion air into the chamber.

2. A rotary kiln device as set forth in claim 1, wherein said means for diverting is formed from said protective sheet.

3. A rotary kiln device as set forth in claim 2, wherein said means for diverting comprises an area of the sheet disposed directly over each opening.

4. A rotary kiln device as set forth in claim 2, wherein said means for diverting comprises a cylindrical structure extending from the sheet and protruding toward each opening, said structure having an outer diameter which is smaller than the corresponding opening and presenting an air scoop around the structure for diverting at least a portion of the combustion air flowing through the opening through the plenum.

5. A rotary kiln device as set forth in claim 1, wherein said spacer means comprises a plurality of dimples formed in the sheet.

6. A rotary kiln device as set forth in claim 5, wherein said spacer means includes spot weld means connecting the dimples to the web.

7. A rotary kiln device as set forth in claim 1, wherein said spacer means mounts the protective means so that a given protective sheet may be removed and replaced without substantial damage to the corresponding web.

8. A rotary kiln device as set forth in claim 1, wherein said protective sheets are constructed of a corrosion resistant material.

9. In a rotary kiln device for burning waste solids, and including an axially rotatable, elongated, generally cylindrical combustor structure defining an internal combustion chamber and comprising a plurality of generally parallel water pipes spaced circumferentially about the periphery of the structure and a plurality of individual webs interconnecting the pipes to present said structure, protective means including at least one protective sheet for each web;

spacer means mounting each sheet on its respective web, internally of the chamber, and in slightly spaced and generally parallel relationship relative to the web, said web and said sheet defining a plenum therebetween; and means for diverting combustion air flowing through the opening in the web and toward the chamber and causing such air to flow through the plenum across the surface of the sheet for cooling the latter prior to introduction of the combustion air into the chamber.

* * * * *